US008215084B2

(12) United States Patent
Bowman et al.

(10) Patent No.: US 8,215,084 B2
(45) Date of Patent: Jul. 10, 2012

(54) EMBEDDABLE BREAKAWAY UTILITY POLE

(75) Inventors: Joseph M. Bowman, Abingdon, VA (US); Greg D. Mercier, Bristol, VA (US)

(73) Assignee: Kearney-National, Inc., New York, NY (US)

( * ) Notice: Subject to any disclaimer, the term of this patent is extended or adjusted under 35 U.S.C. 154(b) by 0 days.

(21) Appl. No.: 12/838,258

(22) Filed: Jul. 16, 2010

(65) Prior Publication Data

US 2010/0281786 A1 Nov. 11, 2010

Related U.S. Application Data

(63) Continuation of application No. 11/783,862, filed on Apr. 12, 2007, now abandoned.

(51) Int. Cl.
*E04C 3/00* (2006.01)

(52) U.S. Cl. ..... 52/854; 52/98; 52/40; 52/651.07; 52/845; 52/848

(58) Field of Classification Search ..... 52/651.01, 52/651.04, 651.07, 831, 836, 844, 845, 848, 52/854, 745.17, 745.15, 296; 138/100, 101, 138/102, 155; 249/13, 14
See application file for complete search history.

(56) References Cited

U.S. PATENT DOCUMENTS

| | | | | |
|---|---|---|---|---|
| 1,482,541 | A * | 2/1924 | Braisted | 52/834 |
| 1,952,217 | A * | 3/1934 | Patton et al. | 228/213 |
| 2,101,270 | A * | 12/1937 | Rice | 138/100 |
| 3,355,998 | A * | 12/1967 | Roemisch | 403/2 |
| 3,755,977 | A * | 9/1973 | Lewis | 52/98 |
| 4,920,715 | A | 5/1990 | Parsons et al. | |
| 5,060,437 | A | 10/1991 | Parsons et al. | |
| 5,481,835 | A * | 1/1996 | Bloom | 52/98 |
| 6,467,233 | B1 | 10/2002 | Maliszewski et al. | |
| 6,470,645 | B1 | 10/2002 | Maliszewski et al. | |
| 6,532,700 | B1 | 3/2003 | Maliszewski et al. | |
| 7,157,642 | B2 * | 1/2007 | Bowman et al. | 174/45 R |
| 2004/0006947 | A1 | 1/2004 | Ashton | |
| 2008/0184654 | A1 * | 8/2008 | Polyzois et al. | 52/651.01 |

* cited by examiner

*Primary Examiner* — Jessica Laux
(74) *Attorney, Agent, or Firm* — Buchanan Ingersoll & Rooney PC

(57) ABSTRACT

An embeddable breakaway utility pole comprises separate upper and lower aluminum pole pieces, wherein the lower pole piece is to be embedded below ground surface. The upper and lower pole pieces are interconnected by a weld which defines a breakaway zone enabling the upper pole piece to break off the lower pole piece in response to vehicular impact. The weld can be connected to a backer ring which provides a guide surface that axially aligns the pole pieces. Alternatively, the pole can be formed of a single pole piece which is welded between its ends to form a weakened region that defines the breakaway zone.

4 Claims, 6 Drawing Sheets

EMBEDDABLE BREAKAWAY UTILITY POLE

BACKGROUND

This application is a continuation of application Ser. No. 11/783,862 filed on Apr. 12, 2007.

The present invention relates to a breakaway utility pole, such as a highway light standard, which is embeddable, i.e., which can be embedded below ground.

There are numerous ways of mounting utility poles such as highway light standards. For example, the lower end of the pole can be bolted above ground to a foundation structure that is embedded in the ground.

Alternatively, the pole itself can be embedded. For example, U.S. Pat. No. 4,920,715 discloses a fiberglass pole whose lower end extends below ground and is attached by an adhesive bond within an embedded sleeve, which is embedded either directly within the soil or within embedded concrete. The pole is of the breakaway type in that the adhesive bond can be broken in response to the pole being subjected to a vehicular impact of predetermined magnitude, enabling the pole to be pulled from the sleeve by the impact.

One problem with fiberglass poles is that they are susceptible to deterioration by UV radiation and thus must be covered by a UV-resistant coating. However, if such a coating is damaged, e.g., when struck by lawnmowers or other objects, UV radiation can contact and cause deterioration of the epoxy component of the fiberglass.

It would be desirable to provide a novel breakaway utility pole of the embeddable type, especially a breakaway embeddable pole which avoids the above described shortcomings associated with fiberglass poles.

BRIEF DESCRIPTION OF THE DRAWING

The objects and advantages of the invention will become apparent from the following detailed description of preferred embodiments thereof in connection with the accompanying drawing in which like numerals designate like elements.

FIG. 2A is a longitudinal sectional view through a part of a utility pole according to the invention.

FIG. 2B is an enlarged fragmentary view of the top end of the lower pole piece of FIG. 2A.

FIG. 2C is a fragmentary view of the joint between upper and lower pole pieces encircled in FIG. 2A.

FIG. 2D is an elevational view of a section of the utility pole shown in FIG. 2A.

FIG. 3A is a longitudinal sectional view through a part of a utility pole according to the invention.

FIG. 3B is an enlarged fragmentary view of the joint between upper and lower pole pieces encircled in FIG. 3A.

FIG. 3C is an elevational view of a section of the utility pole shown in FIG. 3A.

FIG. 4A is a longitudinal sectional view through a part of a utility pole according to the invention.

FIG. 4B is an enlarged fragmentary view of the joint between upper and lower pole pieces encircled in FIG. 4A.

FIG. 4C is an elevational view of a section of the utility pole shown in FIG. 4A.

FIG. 5A is a longitudinal sectional view through a part of a utility pole according to the invention.

FIG. 5B is an enlarge view of a breakaway joint in the pole.

FIG. 5C is an elevational view of a section of the utility pole shown in FIG. 5A.

FIG. 6A is a longitudinal sectional view through a part of a utility pole according to the invention.

FIG. 6B is an enlarged fragmentary view of the joint between upper and lower pole pieces encircled in FIG. 6A.

FIG. 6C is a top plan view of the pole shown in FIG. 6A.

FIG. 6D is an elevational view of a section of the utility pole shown in FIG. 6A.

DETAILED DESCRIPTION OF PREFERRED EMBODIMENTS

Figure 1:
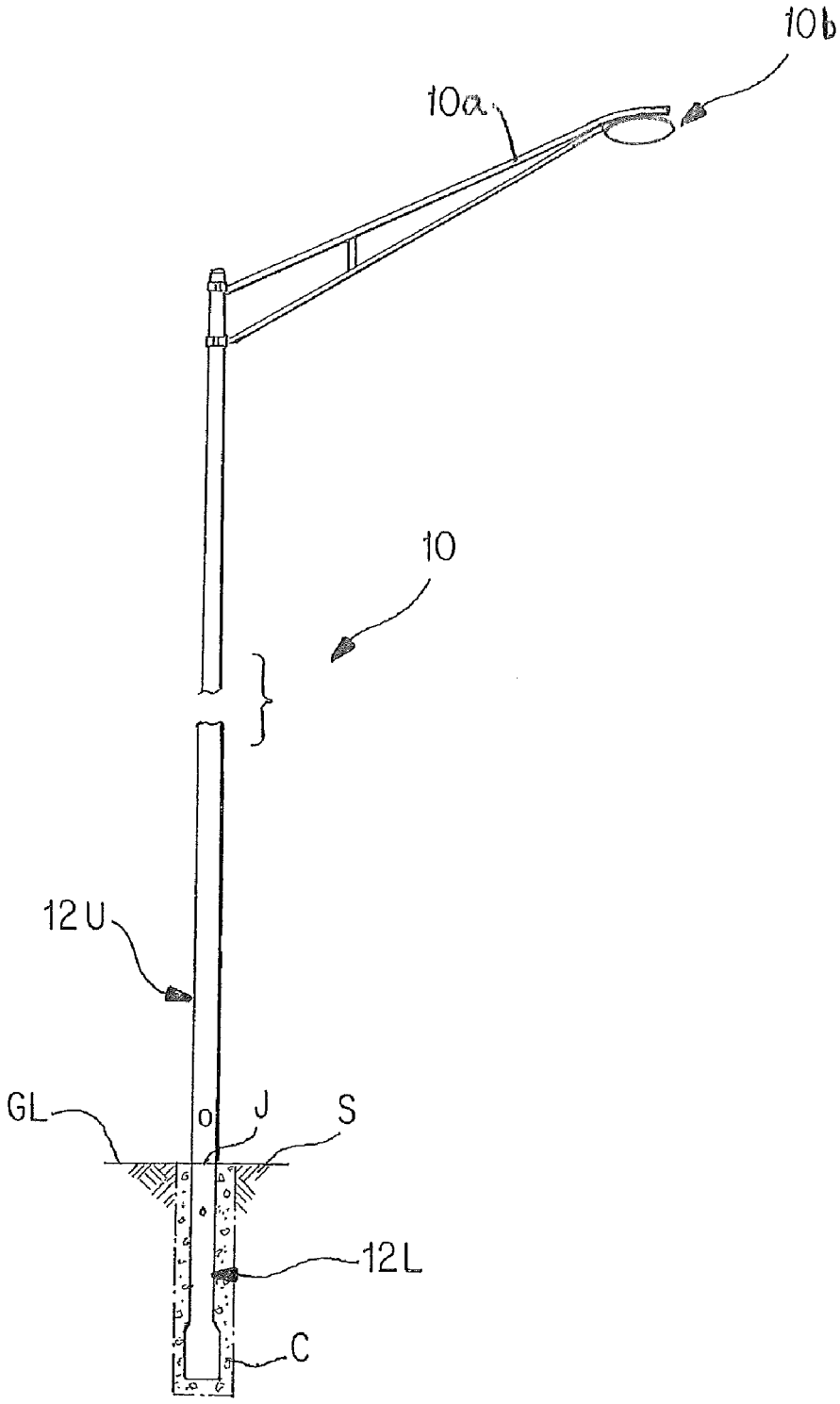
FIG. 1 is an elevational view showing in general a utility pole mounted in accordance with the present invention.
Figure 2A:
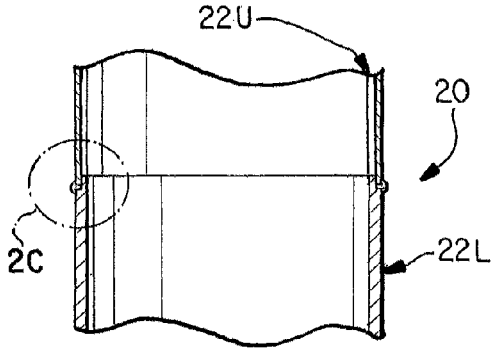
FIGS. 2A-2D depict a first embodiment of the invention.
Figure 2B:
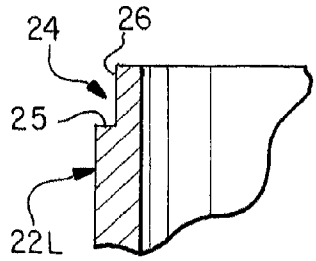
Figure 2C:
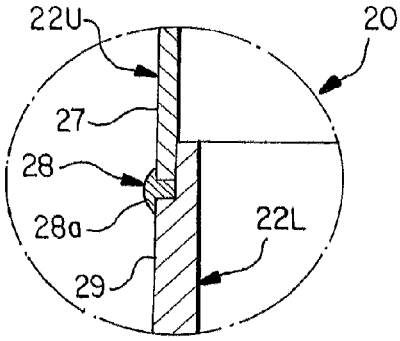
Figure 2D:
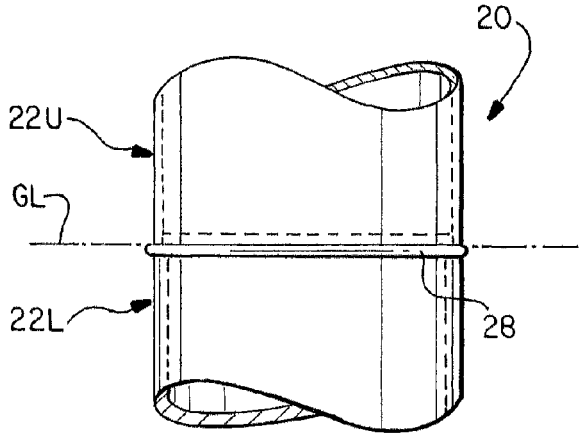

Depicted in FIG. 1 is a side elevational view of an embedded breakaway utility pole 10 according generally to the embodiments of the present invention described below. The pole 10 is in the form of an aluminum light standard and a transverse arm 10*a* carrying a lighting device 10*b*. The light standard includes upper and lower pole regions 12U, 12L that may be formed by separate pole pieces (see FIGS. 2-4 and 6), or by different sections of one pole piece (see FIG. 5). A breakaway joint J is disposed near or at ground level GL as will be described. The upper pole region 12U is tapered, and the lower pole region 12L is embedded in concrete C which itself is embedded directly in the soil S. Alternatively, the lower pole region 12L can be embedded in compacted granular soil fill.

First Embodiment

A first embodiment of an embeddable breakaway utility pole 20 is depicted in FIGS. 2A-2D. That pole 20 comprises a metallic lower pole piece 22L and a separate metallic upper pole piece 22U disposed on the lower pole piece. The walls of the upper and lower pole pieces are of circular cross section and a top of the upper piece is tapered. A top end of the wall of the lower pole piece is radially thicker than a bottom end of the wall of the upper pole piece.

A circumferential recess 24 is formed at the top end of an exterior face of the lower pole piece for defining therein an axial guide surface 26 and a radial support surface 25. The bottom end of the upper pole piece is seated in the recess and is axially guided by the axial guide surface, wherein exterior faces 27, 29 of the upper and lower pole pieces are substantially flush with one another. A weld 28 extends circumferentially around the exterior faces 27, 29 of the upper and lower pole pieces to form a breakaway joint between those pole pieces.

The bottom end of the upper pole piece is spaced slightly above the radial support surface 25 to form an axial gap therebetween, and the weld 28 preferably comprises a groove weld projecting radially through the gap to connect with the guide surface 26 of the recess 24. The groove weld is provided with a fillet reinforcement 28*a*.

The pole pieces are formed of suitable materials, preferably a suitable aluminum material, such as aluminum alloy 6063-T6.

In practice, the utility pole 20 would be mounted by embedding the lower pole piece 22L in the ground, e.g., directly within the soil or within embedded concrete as shown in FIG. 1. The weld joint would be designed to be strong enough to withstand anticipated wind loads, while being weak enough to break in response to a vehicular impact of predetermined magnitude.

Second Embodiment

Figure 3A:
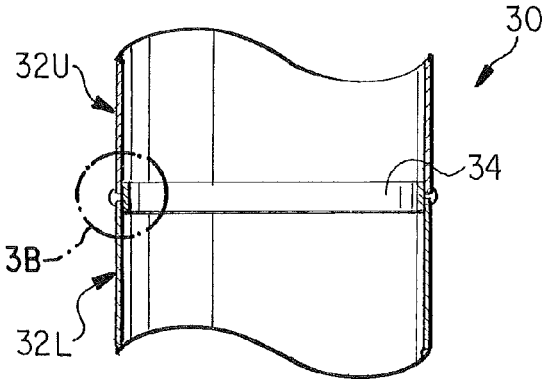
FIGS. 3A-3C depict a second embodiment of the invention.
Figure 3B:
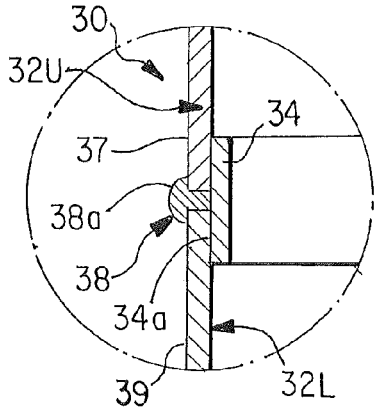
Figure 3C:
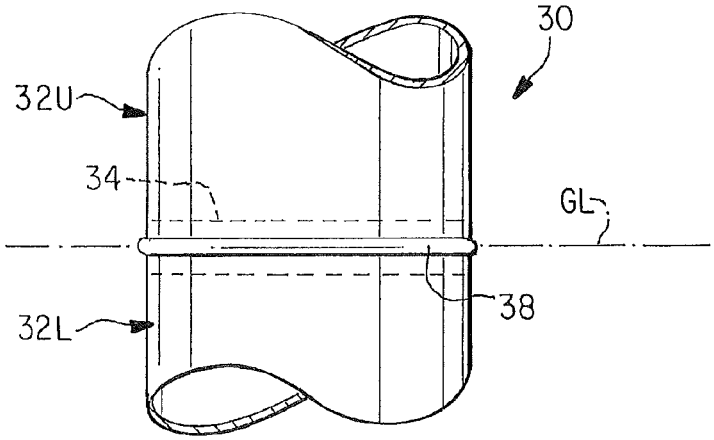

A second embodiment of an embeddable breakaway utility pole 30 is shown in FIGS. 3A-3C. The utility pole comprises a metallic lower pole piece 32L and a separate metallic upper pole piece 32U disposed on the lower pole piece. The upper and lower pole pieces are of circular cross section, and a top section of the upper piece is tapered. A circular backer ring 34 is located within the pole such that a top end of the lower pole piece and a bottom end of the upper pole piece are situated axially between upper and lower ends of the backer ring as shown in FIG. 3B. The backer ring includes a cylindrical outer surface 34*a* with a diameter substantially corresponding to inner diameters of a top end of the lower pole piece and a bottom end of the upper pole piece, respectively. Thus, the outer surface of the backer ring defines an axial guide which brings respective exterior faces 37, 39 of the upper and lower pole pieces into substantially flush relationship.

A weld 38 extends circumferentially around the exterior faces of the upper and lower pole pieces to form a breakaway joint between the upper and lower pole pieces. The bottom end of the upper pole piece is spaced slightly above the top end of the lower pole piece to form a gap therebetween through which the weld 38 extends and becomes joined to the backer ring 34.

The pole pieces 32U, 32L and the backer ring are formed of suitable materials, preferably a suitable aluminum material, such as aluminum alloy 6063-T6. The weld preferably comprises a groove weld with a fillet reinforcement 38*a*.

In practice, the utility pole 30 would be mounted by embedding the lower pole piece 32L in the ground, e.g., directly within the soil or within embedded concrete as shown in FIG. 1. The weld joint would be designed to be strong enough to withstand anticipated wind loads, while being weak enough to break in response to a vehicular impact of predetermined magnitude.

Third Embodiment

Figure 4A:
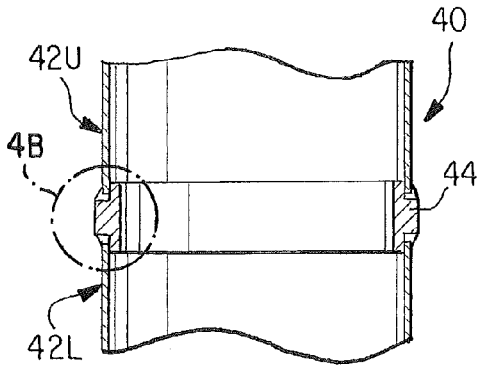
FIGS. 4A-4C depict a third embodiment of the invention.
Figure 4B:
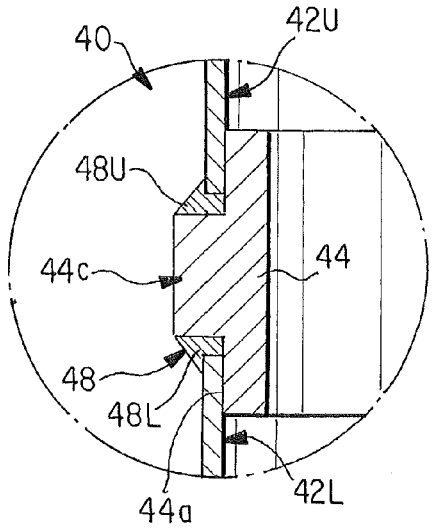
Figure 4C:
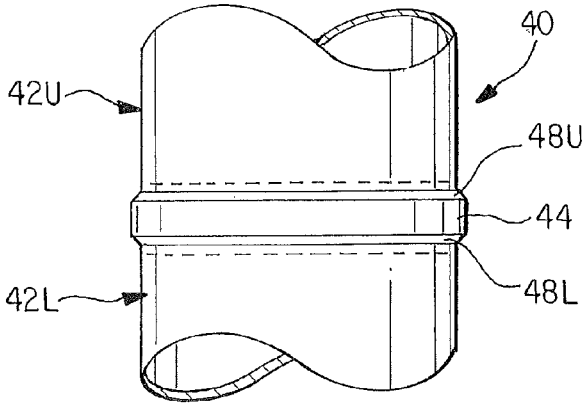

A third embodiment of an embeddable breakaway utility pole 40 is shown in FIGS. 4A-4C and is similar to that of FIGS. 3A-3C. The utility pole 40 comprises a metallic lower pole piece 42L and a separate metallic upper pole piece 42U disposed on the lower pole piece. The upper and lower pole pieces are of circular cross section and the upper piece is tapered. A circular backer ring 44 is located within the pole such that a top end of the lower pole piece and a bottom end of the upper pole piece are situated axially between upper and lower ends of the backer ring as shown in FIG. 4B. The backer ring includes a cylindrical outer surface 44*a* with a diameter substantially corresponding to inner diameters of a top end of the lower pole piece and a bottom end of the upper pole piece, respectively. Thus, the outer surface 44*a* of the backer ring defines an axial guide which brings respective exterior faces 47, 49 of the upper and lower pole pieces into substantially flush relationship.

The backer ring 44 includes an annular projection 44*c* extending radially outwardly from the cylindrical outer surface 44*a* of the backer ring at a location axially between top and bottom ends of the backer ring. The projection projects radially through an axial gap formed between the upper and lower pole pieces. The projection 44*c* includes upper and lower ends spaced from the bottom end of the upper pole piece and the top end of the lower pole piece, respectively.

The weld 48 comprises upper and lower annular weld portions 48U, 48L. The upper weld portion 48U extends radially through the gap between the upper end of the projection and the bottom end of the upper pole piece. The lower weld portion 48L extends radially through the gap between the top end of the lower pole piece and the lower end of the projection. The weld portions are thus joined to the projection 44*c* and to the cylindrical outer surface 44*a* of the backer plate.

The pole pieces 42U, 42L are formed of suitable materials, preferably a suitable aluminum material, such as aluminum alloy 6063-T6, and the backer ring are formed of suitable materials, preferably an aluminum casting (e.g., aluminum alloy 356-T6). Each weld portion preferably comprises a groove weld with a fillet reinforcement.

In practice, the utility pole 40 would be mounted by embedding the lower pole piece 42L in the ground, e.g., directly within the soil or within embedded concrete as shown in FIG. 1. The wall joint would be designed to be strong enough to withstand anticipated wind loads, while being weak enough to break in response to a vehicular impact of predetermined magnitude.

Fourth Embodiment

Figure 5A:
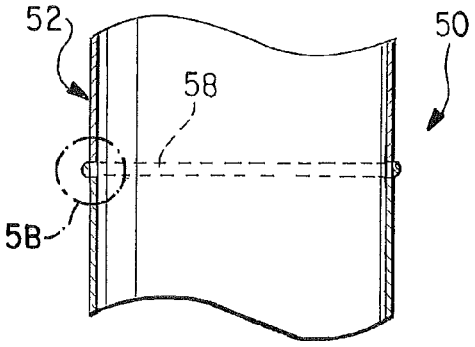
FIGS. 5A-5C depict a fourth embodiment of the invention.
Figure 5B:
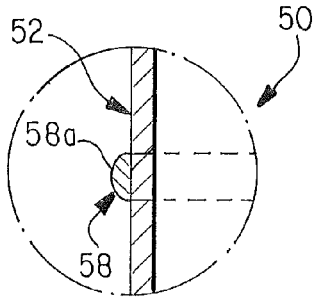
Figure 5C:
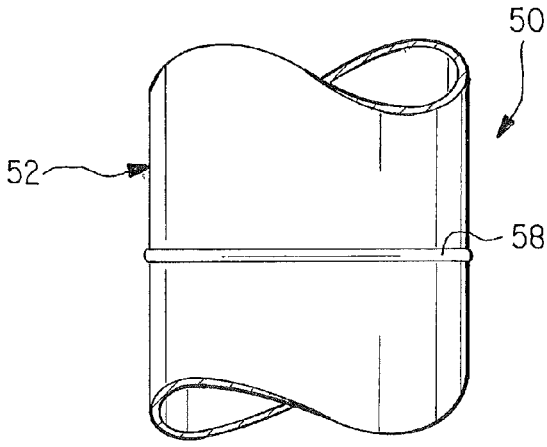
Figure 6A:
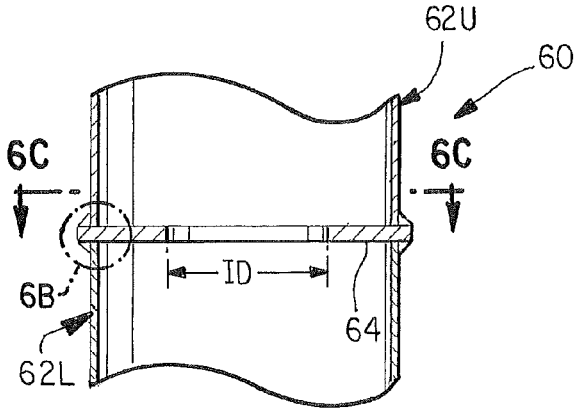
FIGS. 6A-6D depict a fifth embodiment of the invention.
Figure 6B:
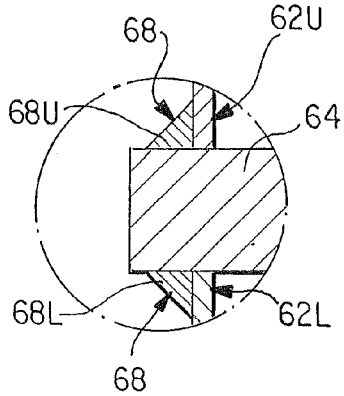
Figure 6C:
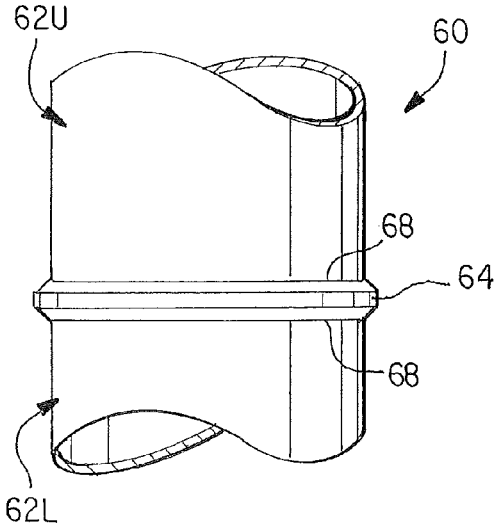
Figure 6D:
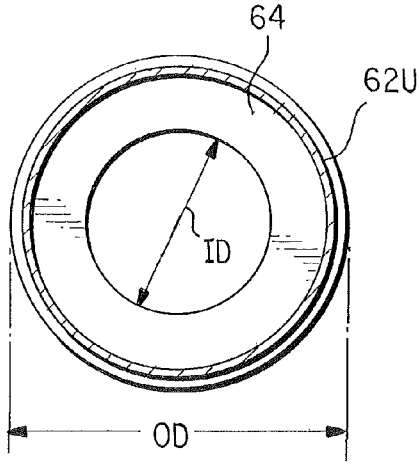

A fourth embodiment of an embeddable breakaway utility pole 50 is depicted in FIGS. 5A-5C, the pole 50 formed of a single tapered pole piece comprised of aluminum and having a circumferential weld 58 extending circumferentially around an exterior surface thereof between top and bottom ends of the pole piece to define a weakened breakaway zone for the pole. The breakaway zone is located nearer to a bottom end of the pole than to a top end of the pole so as to be positionable at or near ground level.

A method of making the embeddable utility pole 50 comprises forming a circumferential weld around an aluminum pole piece between top and bottom ends thereof at a first temper, e.g., T-4 temper, and then heating the pole at a second temper, e.g., T-6 temper, which is harder than the first temper. Such welding and heating of an aluminum pole piece serves to weaken the pole piece, e.g. by about 15%, thus defining a weakened circumferential breakaway zone therein which can be designed strong enough to withstand anticipated wind forces and to break in response to a vehicular impact of predetermined magnitude.

The pole 50 is formed of suitable materials, preferably aluminum alloy 6063-T6, and the welding forms a reinforcing bead 58*a*.

In practice, the utility pole 50 would be mounted by embedding the lower end thereof in the ground, e.g., directly within the soil or within embedded concrete as shown in FIG. 1. The breakaway zone would be designed to be strong enough to withstand anticipated wind loads, while being weak enough to break in response to a vehicular impact of predetermined impact.

Fifth Embodiment

A fifth embodiment of an embeddable breakaway utility pole 60 is shown in FIGS. 6A-6D. That pole 60 comprises a metallic lower pole piece 62L and a separate metallic upper pole piece 62U disposed on the lower pole piece. The upper and lower pole pieces are of circular cross section, and a top section of the upper piece is tapered. A metallic circular plate 64 having inner and outer diameters is situated axially between the upper and lower pole pieces and is welded thereto to form a breakaway joint.

The outer diameter OD of the plate 64 is greater than respective outer diameters of the upper and lower pole pieces, and the inner diameter ID of the plate is less than respective inner diameters of the upper and lower pole pieces. The weld 68 comprises upper and lower weld portions 68U, 68L. The upper weld portion 68U is disposed between an upper end of the plate and an exterior face of the upper pole piece. The lower weld portion 68L is disposed between a lower end of the plate 64 and an exterior face of the lower pole piece.

The pole pieces 62U, 62L are formed of suitable materials, preferably a suitable aluminum material, such as aluminum alloy 6063-T6, and the plate 64 can also be formed of aluminum, e.g., aluminum alloy 6061-T6.

In practice, the utility pole 60 would be mounted by embedding the lower pole piece 62L in the ground, e.g., directly within the soil or within embedded concrete as shown in FIG. 1. The weld joint would be designed to be strong enough to withstand anticipated wind loads, while being weak enough to break in response to a vehicular impact of predetermined magnitude.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. An embeddable breakaway utility pole comprising a light standard and a lighting element attached adjacent an upper end of the light standard, the light standard including a metallic unitary lower pole piece and a separate metallic unitary upper pole piece disposed on the lower pole piece, the upper and lower pole pieces being of circular cross section; a top end of the lower pole piece having a thicker wall than a bottom end of the upper pole piece; the top end of the lower pole piece being of reduced thickness to form a circumferential recess in an exterior face of the top end of the lower pole piece for defining therein an axial guide surface of circular cross section and a radial support surface; the bottom end of the upper pole piece being seated in the recess and axially guided by the axial guide surface, wherein exterior faces of the upper and lower pole pieces are substantially flush with one another; a weld extending circumferentially around the exterior faces of the upper and lower pole pieces to form a breakaway joint between the upper and lower pole pieces, the upper pole piece and the lower pole piece being formed from the same material.

2. The utility pole according to claim 1, wherein the upper and lower pole pieces comprise aluminum.

3. The utility pole according to claim 1, wherein the bottom end of the upper pole piece is spaced above the radial support surface to define an axial gap therebetween, and the weld comprises a groove weld projecting radially through the gap to connect with the guide surface of the recess.

4. The utility pole according to claim 1, further including an arm extending transversely from the pole section; the lighting device carried at a free end of the arm.

* * * * *